US011724921B2

(12) United States Patent
Reif et al.

(10) Patent No.: US 11,724,921 B2
(45) Date of Patent: Aug. 15, 2023

(54) SET-UP METHOD FOR A MOBILE CRANE AND MOBILE CRANE

(71) Applicant: TADANO FAUN GmbH, Lauf a. d. Pegnitz (DE)

(72) Inventors: Rainer Reif, Lauf a. d. Pegnitz (DE); Carsten Henglein, Pinzberg (DE)

(73) Assignee: TADANO FAUN GmbH, Lauf a. d. Pegnitz (DE)

( * ) Notice: Subject to any disclaimer, the term of this patent is extended or adjusted under 35 U.S.C. 154(b) by 0 days.

(21) Appl. No.: 17/555,742

(22) Filed: Dec. 20, 2021

(65) Prior Publication Data

US 2022/0194756 A1 Jun. 23, 2022

(30) Foreign Application Priority Data

Dec. 18, 2020 (DE) ..... 10 2020 216 354

(51) Int. Cl.
*B66C 23/00* (2006.01)
*B66C 23/78* (2006.01)
*B66C 23/42* (2006.01)

(52) U.S. Cl.
CPC ..... *B66C 23/78* (2013.01); *B66C 23/42* (2013.01); *B66C 2700/0371* (2013.01); *B66C 2700/0378* (2013.01)

(58) Field of Classification Search
CPC ..... B66C 23/78; B66C 23/42; B66C 23/36; B66C 2700/0378; B66C 2700/035; B66C 2700/037
See application file for complete search history.

(56) References Cited

U.S. PATENT DOCUMENTS 2,985,318 A * 5/1961 Nickles ..... B66C 23/78 212/301
3,638,805 A * 2/1972 Garnier ..... B66C 23/62 212/175
3,929,204 A * 12/1975 Newell ..... B60P 3/28 180/9.26

(Continued)

FOREIGN PATENT DOCUMENTS

DE 3013513 C3 * 4/1980 ..... B66C 5/00
DE 102008032739 A1 * 12/2009 ..... B66C 23/36

(Continued)

*Primary Examiner* — Emmanuel M Marcelo
(74) *Attorney, Agent, or Firm* — Laurence A. Greenberg; Werner H. Sterner; Ralph E. Locher

(57) ABSTRACT

A mobile crane includes an undercarriage, a superstructure having a crane boom and a crane cable, and a plurality of support carriers for stabilizing the undercarriage in a correct operating state. In order to set-up the mobile crane, a support carrier is disposed in a disassembled state separately from the mobile crane in a waiting position. The support carrier is connected to the crane cable of the crane boom and is shifted between the waiting position and a receiving position which is disposed on the undercarriage. The support carrier is moved by the crane boom between the receiving position and a coupling position in a support box of the undercarriage in such a manner that the support carrier is guided in the support box at least in a substantially tension-free manner. A controller is configured to carry out the set-up method.

9 Claims, 2 Drawing Sheets

(56) References Cited

U.S. PATENT DOCUMENTS

| | | | | | |
|---|---|---|---|---|---|
| 4,640,421 | A * | 2/1987 | Mason | ..... | B66C 23/78<br>212/175 |
| 10,011,465 | B2 | 7/2018 | Boos | | |
| 2018/0072541 | A1 * | 3/2018 | Willim | ..... | B66C 23/78 |

FOREIGN PATENT DOCUMENTS

| | | | | | |
|---|---|---|---|---|---|
| DE | 102008032739 | A1 | 12/2009 | | |
| DE | 102014005499 | A1 | 10/2015 | | |
| DE | 102016011189 | A1 * | 3/2018 | ..... | B66C 23/62 |
| EP | 0260362 | A1 * | 9/1986 | ..... | B66C 23/62 |
| EP | 2886505 | A1 * | 6/2015 | ..... | B66C 23/36 |

* cited by examiner

SET-UP METHOD FOR A MOBILE CRANE AND MOBILE CRANE

CROSS-REFERENCE TO RELATED APPLICATION

This application claims the priority, under 35 U.S.C. § 119, of German Patent Application DE 10 2020 216 354.5, filed Dec. 18, 2020; the prior application is herewith incorporated by reference in its entirety.

FIELD AND BACKGROUND OF THE INVENTION

The invention relates to a set-up method for a mobile crane. The invention further relates to a mobile crane.

Mobile cranes are generally used on building sites at which only a comparatively short period of use, in particular only hours or a few days, may be anticipated for a crane, for which the installation of a stationary rotating tower crane is not worthwhile, or at which a high degree of flexibility is required. Mobile cranes generally have an undercarriage, which is also referred to as a chassis, and a superstructure which is rotatably disposed thereon. The superstructure in turn carries a crane boom which is generally constructed to be telescope-like and also "rockable," that is to say, adjustable in terms of its inclination. In order to increase the (tilting) stability of the undercarriage during crane operation, mobile cranes have so-called support carriers which are pivotably or also extendably articulated to the undercarriage and which during crane operation are laterally deployed in order to increase the standing surface.

With comparatively large mobile cranes, it is further known to be able to disassemble some crane elements for the transport of the mobile crane in order to decrease the axle load of the mobile crane up to the locally permissible range. Inter alia, in that instance, the support carriers can also be disassembled. Generally, the disassembly is carried out by using an auxiliary crane, particularly since the stability of the mobile crane is reduced, and with manual support by crane operators.

SUMMARY OF THE INVENTION

It is accordingly an object of the invention to provide an improved set-up method for a mobile crane and an improved mobile crane, which overcome the hereinafore-mentioned disadvantages of the heretofore-known methods and cranes of this general type.

With the foregoing and other objects in view there is provided, in accordance with the invention, a set-up method for a mobile crane, in particular a mobile crane according to the invention, which has an undercarriage, a superstructure having a crane boom and a crane cable and a number of support carriers for stabilizing the undercarriage in a correct operating state. The or a respective support carrier of the mobile crane is further disposed in a disassembled state separately from the mobile crane in a waiting position.

According to the method, in order to assemble or disassemble the mobile crane, one of the support carriers is connected to the crane cable of the crane boom and is moved or shifted between the waiting position and a receiving position which is disposed on the undercarriage. The support carrier is further moved by the crane boom between the receiving position and a coupling position in a support box of the undercarriage in such a manner that the support carrier is guided in the support box at least in a substantially tension-free manner.

With the objects of the invention in view, there is also provided a mobile crane (1) including an undercarriage (4), a superstructure (6) having a crane boom (10) and a crane cable (24), a number of support carriers (18) for stabilizing the undercarriage (4) in a correct operating state, wherein the or a respective support carrier (18) in a disassembled state is disposed separately from the mobile crane (1) in a waiting position, and a controller which is configured to carry out the set-up method according to the invention.

Advantageous embodiments and developments, some of which are inventive per se, are set out in the dependent claims and the following description.

The term "waiting position" is intended in this instance and below in particular to be understood to be a position which is disposed, for example, on a loading face of a support vehicle, at a set-up location, at which in particular elements of the mobile crane which are intended to be set up are deposited, or the like. The waiting position is consequently a position in which the support carrier is located in a state separated from the mobile crane before the set-up or after the disassembly.

The term "in a substantially tension-free manner" is intended in this instance and below in particular to be understood to mean that the support carrier is guided at least in a substantially tension-free manner, preferably in such a manner that a tilting of the support carrier is prevented. Tensions may in principle occur in this instance, but only to a degree which is negligible with respect to a movability of the support carrier between the receiving position and the coupling position.

Preferably, the undercarriage of the mobile crane has a guiding element for guiding the support carrier between the receiving position and the coupling position. In particular, this is a type of guide rail on which the support carrier slides between the receiving position and the coupling position (and where applicable other positions, for example, a transport position, an operating position and the like).

As a result of the fact that the mobile crane moves the support carrier itself in order to assemble or disassemble it on the undercarriage, the use of an auxiliary crane can advantageously be dispensed with. This is particularly advantageous for comparatively restricted construction sites. Furthermore, the set-up complexity is thus also reduced. Furthermore, operator costs for set-up, in particular a manual displacement of the support carrier in the support box, can also be prevented. This is because generally the support carrier can be displaced by an associated drive only up to the coupling position, but not as far as the receiving position. In this instance, a manual displacement, where applicable using an auxiliary crane, was previously required, which involved the risk of tilting of the support carrier in the support box, in particular on the guiding element.

The advantage of using the crane boom or crane cable belonging to the crane is in this instance that the positions of the (or also the respective) support carrier are always the same, in contrast to using an auxiliary crane which, depending on the nature of the construction site, is always erected at different positions relative to the mobile crane. Consequently, the control or regulation of the movement of the crane boom or the crane cable in order to move the individual support carrier between the receiving position and the coupling position is comparatively simple, but at least the same for each support carrier at each construction site.

Advantageously, when the support carrier is moved between the waiting position and the receiving position, the reduced stability of the mobile crane is taken into account. In particular, a reduced bearing load curve (or also "bearing load table") is thus taken into account. To this end, although the waiting position must also be located within limits preferably predetermined by this bearing load curve, particularly the mobile crane is operated in this case with a steeply positioned and/or short (that is to say, not or hardly telescopically extended) crane boom in order to retain the crane engagement location as close as possible to the mobile crane, specifically on the undercarriage and consequently to keep tilting moments small.

Preferably, therefore, in the context of the set-up method, there is also further set out provisions as to where the waiting position of the support carrier must or is permitted to be located relative to the undercarriage.

In another advantageous method variant, the crane boom and optionally also the crane cable are controlled in such a manner that it/they travel(s) over a preprogrammed trajectory for the movement of the support carrier between the receiving position and the coupling position. In other words, a so-called path control is used for the crane boom or the crane cable. This is distinguished in particular in that the path between the start and target points is predetermined, in particular by a large number of support locations which can also be referred to as respective intermediate targets. This path control of the crane boom, optionally in combination with the crane cable, also represents an independent invention, which in principle is also independent of the set-up of the support carrier. For example, such a path control can be used for other set-up objectives, for example, for setting up counterweights and the like.

In a preferred variant of the above-described path control, the above-mentioned trajectory is selected to be in particular parallel with the above-described guiding element, therefore, preferably linear and preferably also at right-angles with respect to the undercarriage, in particular relative to a longitudinal axis and/or vertical axis of the undercarriage.

In another advantageous method variant, the crane boom and optionally also the crane cable—additionally or optionally alternatively to the path control described above—are moved in a load-controlled manner. It is thereby possible for forces which occur during movement, in particular at the beginning of a tilting, of the support carrier and which in most cases lead to a displacement of the support carrier from the current desired position thereof along the movement path, to be taken into account and compensated for. In this variant, therefore, a load-related displacement is advantageously compensated for. In the event that this load control is used in the context of the path control, such a load-related displacement is used, for example, as a "disturbance variable" or as a comparable influence on the path control and taken into account (in particular by using compensation measures).

For the load control described above, force sensors are preferably used which are connected to the crane cable and/or the crane boom and which are read during the movement of the support carrier.

In order to disassemble, that is to say, to dismantle the (or the respective) support carrier, in an advantageous method variant it is initially moved by using an associated drive—in particular by using a hydraulic drive, for example, a hydraulic cylinder—into the coupling position. In this coupling position, the support carrier is coupled to the crane cable and (preferably subsequently) uncoupled from the undercarriage. Subsequently, the support carrier according to the above description is first moved into the receiving position (which is preferably located at the end of the above-mentioned guiding element) and from there moved to the waiting position. The set-up of the support carrier is accordingly carried out in the reverse order. After the movement from the receiving position into the coupling position, the support carrier is thus coupled to the undercarriage, in particular to the above-mentioned drive, uncoupled from the crane cable and subsequently moved by the drive.

As described above, the mobile crane according to the invention has the undercarriage, the superstructure having the crane boom and the crane cable and the number of support carriers, wherein the or the respective support carrier of the mobile crane is disposed in the disassembled state separately from the mobile crane in a waiting position. Furthermore, the mobile crane has a controller (also referred to as a "control device") which—preferably in the form of a microcontroller and in particular in technical programming terms—is configured to carry out the above-described set-up method automatically, optionally in cooperation with crane operators.

The conjunction "and/or" is in this instance and below intended to be understood in particular to mean that the features linked by this conjunction may be formed both together and as alternatives to each other.

Other features which are considered as characteristic for the invention are set forth in the appended claims.

Although the invention is illustrated and described herein as embodied in a set-up method for a mobile crane and a mobile crane, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
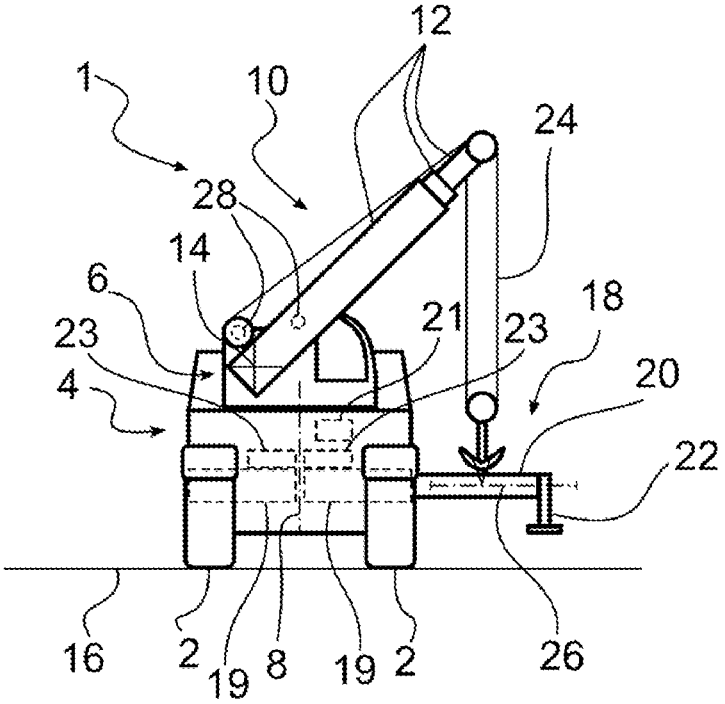
FIG. 1 is a diagrammatic, elevational view of the rear of a mobile crane which is supported in the correct operating state on support carriers.
Figure 2:
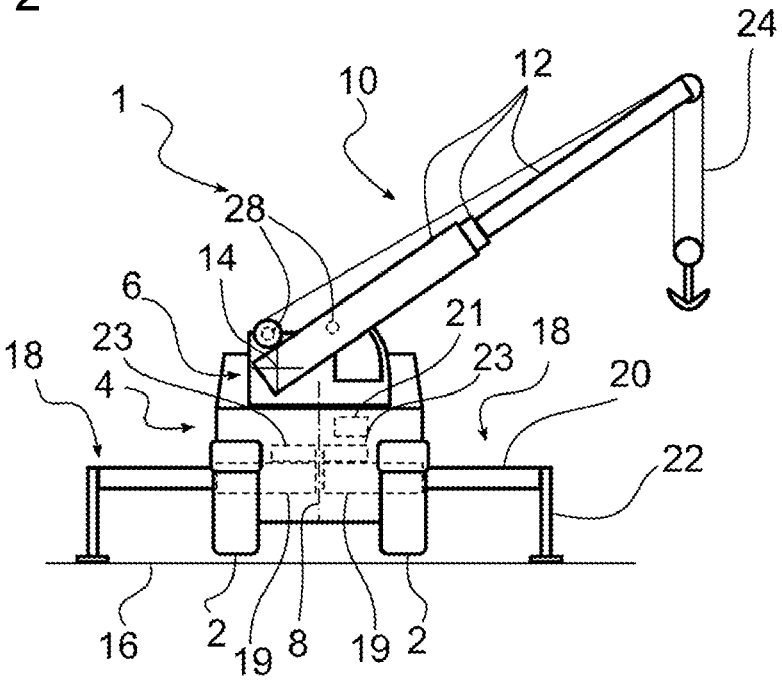
FIG. 2 is a view similar to FIG. 1 of the mobile crane during a set-up operation.

Referring now in detail to the figures of the drawings, in which mutually corresponding components are always given the same reference numerals, and first, particularly, to FIG. 1 thereof, there is seen a diagrammatic illustration of a mobile crane 1. The mobile crane 1 has an undercarriage 4 (also referred to as a "chassis") which carries wheels 2 and the mobile crane 1 has a superstructure 6. The superstructure 6 can be pivoted relative to the undercarriage 4 about a rotation axis 8 which is orientated perpendicularly to the undercarriage 4. The superstructure 6 carries a crane boom 10 which has a plurality of segments 12 that are telescope-like with respect to each other, and which can be "rocked" about a rocking axis 14, that is to say, they can be pivoted through a rocking angle relative to the ground 16. In order to enable a stable upright position even with a laterally rotated superstructure 6 and an unloading crane boom 10 (see FIG. 1), the mobile crane 1 further also includes so-called support carriers 18 specifically four of this type in this instance. These carriers can be inserted into and pushed out of support boxes 19 which are disposed in the undercarriage 4. The support carriers 18 have a support component element 20, constructed by way of example in this instance as an I-shaped profile, and a telescope-like (see FIG. 1 and FIG. 2) support base 22. Furthermore, the mobile crane 1 includes a crane cable 24 which is guided over the crane boom 10.

Figure 3:
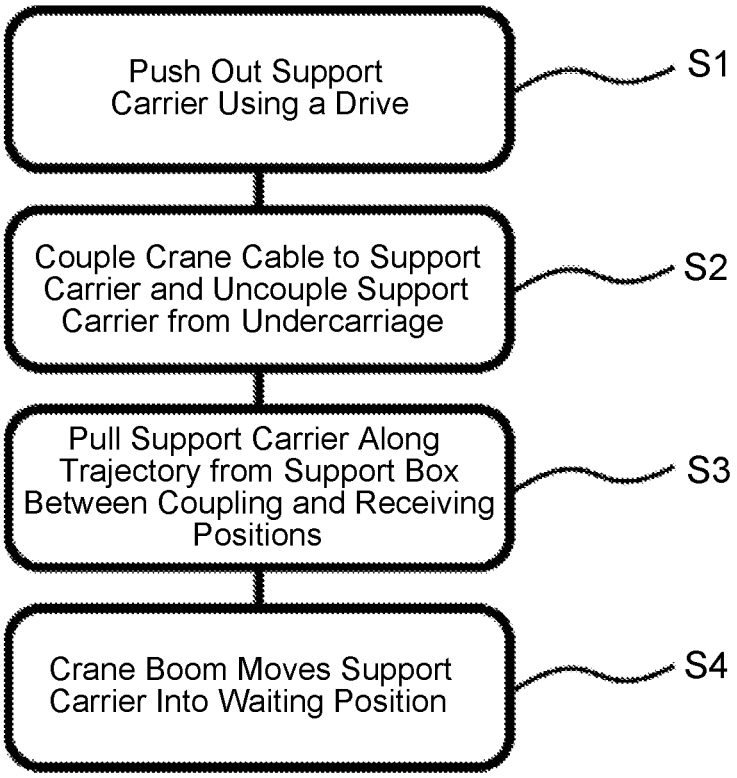
FIG. 3 is a flow chart of a set-up method for the mobile crane.

Depending on the axial load of the mobile crane 1—as in the present embodiment—the support carriers 18 are removably retained on the mobile crane, specifically on the undercarriage 4, in particular received in the support boxes 19 since, on many roads, the mobile crane 1 in the embodiment thereof illustrated in FIG. 1 exceeds the permissible axial load. Therefore, for travelling on such a road, the support carriers 18 are disassembled. Generally, an auxiliary crane is used for this purpose and unloads the support carriers 18 from the loading surface of a support vehicle and lifts them onto the mobile crane 1, specifically on the support boxes 19. In order to avoid the use of such an auxiliary crane, and the complexity which is associated therewith, the mobile crane 1 is configured to carry out a set-up method, which is described below in greater detail with reference to FIGS. 2 and 3. To this end, the mobile crane 1 controller 21 (also referred to as a control device) which is configured in technical programming terms to automatically carry out the set-up method.

In order to dismantle any support carrier 18, it is first pushed out in a first method step S1 by using a drive 23—in this instance, specifically a hydraulic cylinder—along a guide rail (which is not illustrated) into a coupling position. Furthermore, in the context of a "reduced" bearing load curve (generally in the form of a table) which determines permissible pivot ranges for various hook loads, in this instance with unused support carriers 18, the crane boom 10 is operated with a comparatively short length and the steepest possible rocking angle so that a tilting movement on the mobile crane 1 is kept as small as possible.

If the support carrier 18 is in the coupling position, in a second method step S2 the crane cable 24 is coupled to the support carrier 18 and the support carrier 18 is uncoupled from the undercarriage 4, specifically from the drive 23. In this state, the support carrier 18 rests freely in the guide rail.

In a following method step S3, there is carried out a path control of the crane boom 10 and the crane cable 24 in that the support carrier 18 which is attached to the crane cable 24 is pulled along a linear trajectory 26 from the support box, specifically between the coupling position and a receiving position which coincides with the end of the guide rail. The trajectory 26 is in this instance selected in such a manner that the support carrier 18 is moved in a tension-free manner, that is to say, without forces which could lead to a tilting of the support carrier 18 in the support box or on the guide rail, between the coupling position and the receiving position. Additionally or alternatively, the support carrier 18 is pulled in a load controlled manner. In that case, the movement of the boom and/or of the crane cable 24 is controlled based on the respective load that is derived from the signals of respectively assigned force sensors 28.

In a following method step S4, the support carrier 18 is moved by using the crane boom 10 into a waiting position which is preferably located on the loading face of the support vehicle (not illustrated). To this end, the support vehicle is preferably parked in extension of the mobile crane 1, that is to say, in front of or behind the mobile crane 1, since in this instance the tilting stability of the mobile crane 1 is sufficiently high, even without support carriers 18, so that the crane boom 10 where applicable can project further than illustrated in FIG. 2.

In order to assemble (or mount) the respective support carriers 18, the method steps described above are repeated in a correspondingly transposed order.

In an optional variant, the above-described path control is supplemented by a load control, through the use of which a load-dependent displacement of the support carriers 18 during the method step S3 is intended to be compensated for.

The subject-matter of the invention is not limited to the embodiment described above. Instead, other embodiments of the invention can be derived from the above description by the person skilled in the art.

The following is a summary list of reference numerals and the corresponding structure used in the above description of the invention:

1 Mobile crane
2 Wheel
4 Undercarriage
6 Superstructure
8 Rotation axis
10 Crane boom
12 Segment
14 Rocking axis
16 Ground
18 Support carrier
19 support box
20 Support component element
21 control
22 Support base
23 drive
24 Crane cable
26 Trajectory
28 force sensor
S1 Method step
S2 Method step
S3 Method step
S4 Method step

The invention claimed is:

1. A set-up method for a mobile crane, the set-up method comprising:

providing a mobile crane including an undercarriage, a superstructure having a crane boom and a crane cable, and a plurality of support carriers for stabilizing the undercarriage in a correct operating state;

placing one of the support carriers in a disassembled state in a waiting position separately from the mobile crane;

connecting the support carrier to the crane cable of the crane boom and transferring the support carrier between the waiting position and a receiving position disposed on the undercarriage;

using the crane boom to move the support carrier between the receiving position and a coupling position in a support box of the undercarriage while guiding the support carrier in the support box in an at least substantially tension-free manner; and moving the crane boom along a preprogrammed trajectory for the movement of the support carrier between the receiving position and the coupling position.

2. The set-up method according to claim 1, which further comprises taking a reduced stability of the mobile crane into account when the support carrier is transferred between the waiting position and the receiving position.

3. The set-up method according to claim 1, which further comprises moving the crane cable along with the crane boom along the preprogrammed trajectory.

4. The set-up method according to claim 1, which further comprises orienting the trajectory in a linear manner.

5. The set-up method according to claim 4, which further comprises orienting the trajectory at right-angles with respect to the undercarriage.

6. The set-up method according to claim 1, which further comprises disassembling the support carrier by:

initially using a drive to move the support carrier into the coupling position;

coupling the support carrier to the crane cable in the coupling position; and uncoupling the support carrier from the undercarriage.

7. A mobile crane, comprising:

an undercarriage;

a superstructure having a crane boom and a crane cable;

a plurality of support carriers for stabilizing said undercarriage in a correct operating state, said support carriers, in a disassembled state, being disposed separately from the mobile crane in a waiting position; and a controller configured to carry out the set-up method according to claim 1.

8. A set-up method for a mobile crane, the set-up method comprising:

providing a mobile crane including an undercarriage, a superstructure having a crane boom and a crane cable, and a plurality of support carriers for stabilizing the undercarriage in a correct operating state;

placing one of the support carriers in a disassembled state in a waiting position separately from the mobile crane;

connecting the support carrier to the crane cable of the crane boom and transferring the support carrier between the waiting position and a receiving position disposed on the undercarriage;

using the crane boom to move the support carrier between the receiving position and a coupling position in a support box of the undercarriage while guiding the support carrier in the support box in an at least substantially tension-free manner;

moving the crane boom in a load-controlled manner;

moving the crane cable in a load-controlled manner; and reading-out force sensors connected to at least one of the crane cable or the crane boom for the load control.

9. A mobile crane, comprising:

an undercarriage;

a superstructure having a crane boom and a crane cable;

a plurality of support carriers for stabilizing said undercarriage in a correct operating state, said support carriers, in a disassembled state, being disposed separately from the mobile crane in a waiting position; and a controller configured to carry out the set-up method according to claim 8.

* * * * *